US009030920B2

(12) United States Patent
Hessler

(10) Patent No.: US 9,030,920 B2
(45) Date of Patent: May 12, 2015

(54) RESONATOR WITH MATCHED BALANCE SPRING AND BALANCE

(71) Applicant: The Swatch Group Research and Development Ltd, Marin (CH)

(72) Inventor: Thierry Hessler, St-Aubin (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/011,892

(22) Filed: Aug. 28, 2013

(65) Prior Publication Data

US 2014/0064044 A1 Mar. 6, 2014

(30) Foreign Application Priority Data

Sep. 4, 2012 (EP) ..... 12182973

(51) Int. Cl.
*G04B 17/06* (2006.01)
*G04C 3/04* (2006.01)

(52) U.S. Cl.
CPC ..... *G04C 3/04* (2013.01); *G04B 17/063* (2013.01); *G04B 17/066* (2013.01)

(58) Field of Classification Search
CPC ..... G04B 17/063
USPC ..... 368/169, 175
See application file for complete search history.

(56) References Cited

U.S. PATENT DOCUMENTS

| | | | | |
|---|---|---|---|---|
| 7,661,875 | B2 * | 2/2010 | Verardo et al. | 368/171 |
| 2005/0068852 | A1 | 3/2005 | Hessler et al. | |
| 2008/0008050 | A1 | 1/2008 | Bourgeois | |
| 2010/0034057 | A1 * | 2/2010 | Levingston | 368/175 |
| 2010/0054090 | A1 | 3/2010 | Orny et al. | |
| 2011/0305120 | A1 | 12/2011 | Hessler et al. | |

FOREIGN PATENT DOCUMENTS

| | | | |
|---|---|---|---|
| EP | 1 519 250 | A1 | 3/2005 |
| EP | 1 605 182 | A1 | 12/2005 |
| EP | 2 395 661 | A1 | 12/2011 |
| WO | WO 2008/080570 | A2 | 7/2008 |

OTHER PUBLICATIONS

European Search Report issued on Feb. 14, 2013 in Europe 12182973, filed on Sep. 4, 2012 ( with English Translation).

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A resonator includes a balance spring formed in a single crystal quartz with crystallographic axes x, y, z, where the x axis is an electrical axis and the y axis is a mechanical axis, and cooperating with a balance. A thermal expansion coefficient of the balance is comprised between +6 ppm.° C.$^{-1}$ and +9.9 ppm.° C.$^{-1}$ and a cut angle of the balance spring to the z axis of the single crystal quartz is comprised between −5° and +5°, so as to match the balance to the balance spring.

5 Claims, 2 Drawing Sheets

RESONATOR WITH MATCHED BALANCE SPRING AND BALANCE

This application claims priority from European patent application no. 12182973.3 filed on Sep. 4, 2012, the entire disclosure of which is incorporated by reference.

FIELD OF THE INVENTION

The invention relates to a resonator with a matched balance spring and balance and more specifically to a balance spring formed from single crystal quartz.

BACKGROUND OF THE INVENTION

EP Patent No 1519250 discloses the manufacture of a single crystal quartz balance spring. However single crystal quartz is not easy to match in practice.

SUMMARY OF THE INVENTION

It is an object of the present invention to overcome all or part of the aforementioned drawbacks, by providing improved matching between a quartz balance spring and a balance.

Thus, the invention relates to a resonator comprising a balance spring formed of single crystal quartz with crystallographic axes x, y, z, where the x axis is the electrical axis and the y axis is the mechanical axis, and cooperating with a balance, characterized in that the thermal expansion coefficient of the balance is comprised between +6 ppm.° C.$^{-1}$ and +9.9 ppm.° C.$^{-1}$ where the cut angle of the balance spring with respect to the z axis of said single crystal quartz is between −5° and +5°, so that the resonator is less sensitive to temperature variations.

In accordance with other advantageous features of the invention:

- the thermal expansion coefficient of the balance is substantially equal to +9 ppm.° C.$^{-1}$ where the cut angle of the balance spring with respect to the z axis of said single crystal quartz is substantially equal to +2°.
- at least one portion of the balance is made of titanium or platinum;
- the thermal expansion coefficient of the balance is substantially equal to +9.9 ppm.° C.$^{-1}$ where the cut angle of the balance spring with respect to the z axis of said single crystal quartz is substantially equal to +5°;
- at least one portion of the balance is made of durimphy.

BRIEF DESCRIPTION OF THE DRAWINGS

Other features and advantages will appear clearly from the following description, given by way of non-limiting illustration, with reference to the annexed drawings, in which.

DETAILED DESCRIPTION OF PREFERRED EMBODIMENTS

Figure 3:
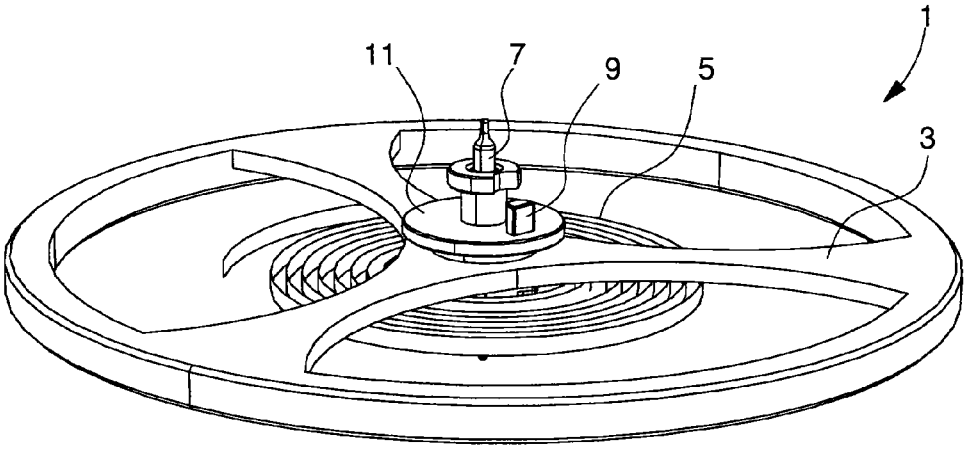
FIG. 3 is a schematic view of a sprung balance resonator according to the invention.

As illustrated in FIG. 3, the invention relates to a resonator 1 of the type with a balance 3—balance spring 5. Balance 3 and balance spring 5 are preferably mounted on the same arbour 7. In this resonator 1, the moment of inertia I of balance 3 answers to the formula:

$$I=mr^2 \tag{1}$$

where m represents the mass and r the turn radius which evidently depends on the thermal expansion coefficient $\alpha_b$ of the balance.

Further, the elastic constant C of balance spring 5 answers to the formula:

$$C=\frac{Ehe^3}{12L} \tag{2}$$

where E is the Young's modulus of the balance spring, h the height, e the thickness and L the developed length thereof.

Finally, the frequency θ of sprung balance resonator 1 answers to the formula:

$$f=\frac{1}{2\pi}\sqrt{\frac{C}{I}} \tag{3}$$

Naturally, it is desirable for the resonator to have zero frequency variation with temperature. In the case of a sprung balance resonator, frequency variation with temperature substantially follows the following formula:

$$\frac{\Delta f}{f}\frac{1}{\Delta T}=\frac{1}{2}\left\{\frac{\partial E}{\partial T}\frac{1}{E}+3\cdot\alpha_s-2\cdot\alpha_b\right\} \tag{4}$$

where:

$$\frac{\Delta f}{f}\frac{1}{\Delta T}$$

is the frequency variation with temperature;

$$\frac{\partial E}{\partial T}\frac{1}{E}$$

is the Young's modulus variation with temperature, i.e. the thermoelastic coefficient (CTE) of the balance spring;

$\alpha_s$ is the thermal expansion coefficient of the balance spring, expressed in ppm.° C.$^{-1}$;

$\alpha_b$ is the thermal expansion coefficient of the balance, expressed in ppm.° C.$^{-1}$.

Since the oscillations of any resonator intended for a time or frequency base have to be maintained, the maintenance system may also contribute to thermal dependence, such as, for example, a Swiss lever escapement (not shown) cooperating with the impulse pin 9 of the roller 11, also mounted on arbour 7.

Figure 1:
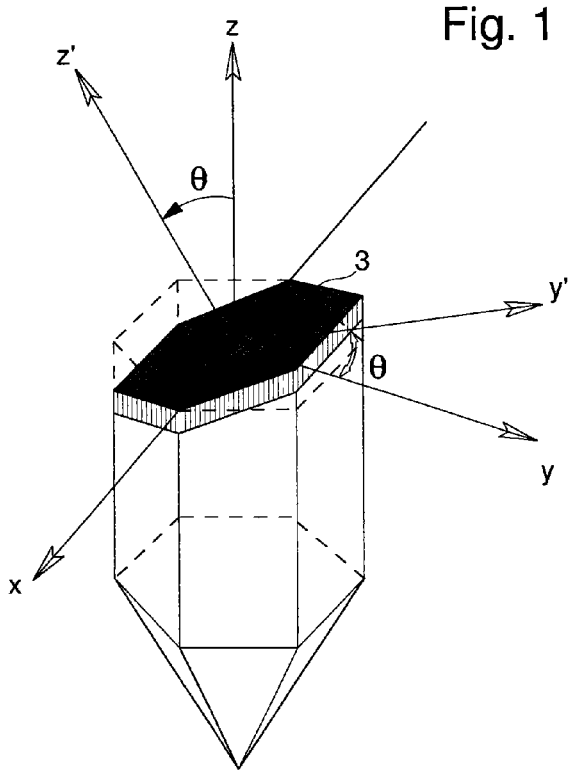
FIGS. 1 and 2 are schematic views of the cut angle θ of a balance spring made of single crystal quartz according to the invention.
Figure 2:
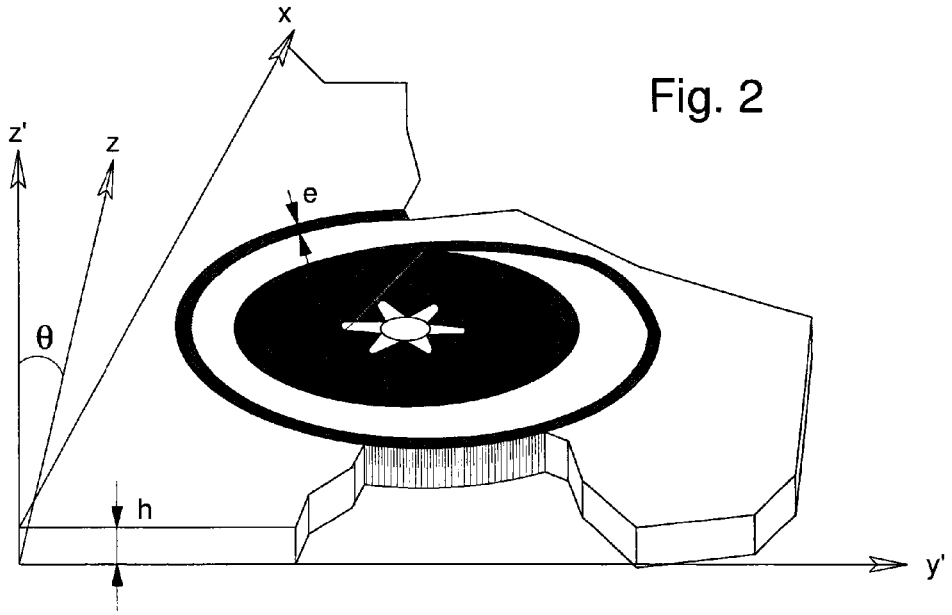

As illustrated in FIGS. 1 and 2, the invention more specifically concerns a resonator 1 wherein the balance spring 5 is formed from a single crystal quartz having crystallographic axes x, y, z, where the x axis is the electrical axis and the y axis, the mechanical axis. These Figures show that the orientation of height h of the coils is substantially the same as the crystallographic z axis. More specifically, height h forms an angle θ with the z axis which may be positive or negative. The features of balance spring 5 can be varied by modifying this angle θ without having to change the geometry of the balance spring.

It is thus clear from formulae (1)-(4) that it is possible to match balance spring 5 with balance 3 so that the frequency f of resonator 1 is virtually insensitive to temperature variations. In addition to excellent thermal properties, the use of quartz to manufacture a balance spring 5 also offers the advantage of possessing excellent mechanical and chemical properties, in particular as regards ageing and the very low sensitivity to magnetic fields.

With a cut angle θ substantially equal to +2°, it was thus empirically found that the thermal expansion coefficient $\alpha_b$ of balance 3 had to be substantially equal to +9 ppm.° C.$^{-1}$ to obtain a thermic coefficient substantially equal to +0.06 seconds per day.° C.$^{-1}$ which is well below the required conditions of The Official Swiss Chronometer Testing Unit (COSC) of ±0.6 seconds per day.° C.$^{-1}$.

More generally, for the thermic coefficient of resonator 1 to remain substantially at ±0.1 seconds per day.° C.$^{-1}$, i.e. still within COSC conditions, and with a cut angle θ of balance spring 5 to the z axis of the single crystal quartz of between −5° and +5°, the thermal coefficient $\alpha_b$ of balance 3 is comprised between +6 ppm. ° C.$^{-1}$ and +9.9 ppm.° C.$^{-1}$.

To comply with these thermal expansion coefficients $\alpha_b$, balance 3 may in particular comprise titanium and/or durimphy (symbol AFNOR: Z2NKD 18-09-05) and/or platinum. Indeed, the thermal expansion coefficients $\alpha_b$, of titanium and platinum are substantially equal to +9 ppm.° C.$^{-1}$ and the expansion coefficient of durimphy is substantially equal to +9.9 ppm.° C.$^{-1}$. Further, advantageously, it should be noted that durimphy may have low sensitivity to magnetic fields according to its tempering temperature.

Of course, this invention is not limited to the illustrated example but is capable of various variants and alterations that will appear to those skilled in the art. In particular, any other material which complies with the expansion coefficients explained above may be used for balance 3.

The invention claimed is:

1. A resonator comprising:

a balance spring formed in a single crystal quartz with crystallographic axes x, y, z, where the x axis is an electrical axis and the y axis is a mechanical axis, and cooperating with a balance, wherein a thermal expansion coefficient of the balance is substantially equal to +9 ppm.° C.$^{-1}$ and wherein a cut angle of the balance spring to the z axis of the single crystal quartz is substantially equal to +2° so that the resonator is less sensitive to temperature variations.

2. The resonator according to the claim 1, wherein at least one portion of the balance is made of titanium.

3. The resonator according to the claim 1, wherein at least one portion of the balance is made of platinum.

4. A resonator comprising:

a balance spring formed in a single crystal quartz with crystallographic axes x, y, z, where the x axis is an electrical axis and the y axis is a mechanical axis, and cooperating with a balance, wherein a thermal expansion coefficient of the balance is substantially equal to 9.9 ppm.° C.$^{-1}$ and wherein a cut angle of the balance spring to the z axis of the single crystal quartz is substantially equal to +5° so that the resonator is less sensitive to temperature variations.

5. The resonator according to the claim 4, wherein at least one portion of the balance is made of durimphy.

* * * * *